United States Patent [19]

Lazarchik

[11] Patent Number: 4,781,626

[45] Date of Patent: Nov. 1, 1988

[54] KEYING SYSTEM FOR CONNECTOR FAMILIES

[75] Inventor: Daniel B. Lazarchik, Camp Hill, Pa.

[73] Assignee: AMP Incorporated, Harrisburg, Pa.

[21] Appl. No.: 423,486

[22] Filed: Sep. 24, 1982

[51] Int. Cl.[4] ..... H01R 13/64

[52] U.S. Cl. ..... 439/680

[58] Field of Search ..... 339/184 R, 184 M, 186 R, 339/186 M; 439/677-681

[56] References Cited

U.S. PATENT DOCUMENTS

| | | | |
|---|---|---|---|
| 3,137,537 | 6/1964 | Cole et al. | 339/186 M |
| 3,275,765 | 9/1966 | Fevdon et al. | 339/186 M |
| 3,287,031 | 11/1966 | Simmons et al. | 285/27 |
| 3,848,950 | 11/1974 | McCormick et al. | 339/186 M |
| 3,873,172 | 3/1975 | Paullus | 439/498 |
| 3,915,542 | 10/1975 | Schou-Kjeldsen | 339/186 M |
| 4,210,376 | 7/1920 | Hughes et al. | 339/176 M |
| 4,331,458 | 5/1982 | Liljestrand | 339/184 |
| 4,379,606 | 4/1983 | Clark et al. | 339/184 M |

FOREIGN PATENT DOCUMENTS

| | | | |
|---|---|---|---|
| 0040941 | 12/1981 | European Pat. Off. . | |
| 0073112 | 3/1983 | European Pat. Off. . | |
| 0616550 | 2/1933 | Fed. Rep. of Germany | 339/186 M |
| 0708208 | 7/1941 | Fed. Rep. of Germany | 339/184 R |
| 2613907 | 10/1977 | Fed. Rep. of Germany . | |

*Primary Examiner*—J. Patrick McQuade

*Attorney, Agent, or Firm*—Frederick W. Raring; David L. Smith

[57] ABSTRACT

Electrical connector assembly comprises a plug and a receptacle. The receptacle has a plug-receiving opening which receives the forward portion of the plug. A primary keying system is provided which permits insertion of the plug of the assembly into the opening but which precludes insertion of a similar, but more narrow, plug into the opening. A secondary keying system is provided for specifically keying the plug and receptacle to each other. The secondary keying system prevents insertion of a properly sized plug into the opening which is not intended for insertion. The primary keying system is advantageous when a series or family of connector assemblies are produced with the different assemblies of the family being generally similar but having increasing numbers of terminals and therefore increasing width.

3 Claims, 3 Drawing Sheets

90
92

93
89
92
90

93

93
89
90

93
89
90

KEYING SYSTEM FOR CONNECTOR FAMILIES

FIELD OF THE INVENTION

This invention relates to keying systems for electrical connector assemblies of the type comprising a receptacle having a plug receiving opening therein and a plug which is received in the opening. The embodiment of the invention described below shows the keying system as provided on connector assemblies of the general types shown in U.S. Pat. Nos. 4,193,654, 4,210,376, and 4,331,458. The principles of the invention can, however, be used to advantage with other types of connectors.

BACKGROUND OF THE INVENTION

U.S. Pat. Nos. 4,193,654, 4,210,376, and 4,221,458 show a known type of electrical connector assembly which is coming into widespread use in the communications industry and on computer and computer related equipment. The receptacles shown in the above identified U.S. patents are dimensioned to receive connector plugs of the general type shown in U.S. Pat. No. 3,860,316.

The receptacles and plugs referred to above usually have no more than eight terminals therein and it is usually not considered necessary to provide keying systems to key a particular plug to a particular receptacle. However, there is a need for connector assemblies of the general type described above having greatly increased numbers of contact terminals therein and there is a need for a family or series of connectors having varying numbers of terminals therein. These requirements are particularly felt by manufacturers of computers and computer-related equipment.

Where connector assemblies of the type under consideration are manufactured in a range of sizes, as regards the number of terminals in the assembly, it is possible to insert a plug part of the assembly having a lesser number of contact terminals into a receptacle having a greater number of contact terminals because of the fact that the plug and receptacle of two assemblies of different sizes differ only in the width of the plug and the width of the plug-receiving opening in the receptacle. It can readily be appreciated that as a number of connector assemblies of different sizes are mounted adjacent to each other, a plug might be mis-mated with a receptacle having a greater number of contact terminals than the plug; in other words, the plug can be simply inserted into the center portion of the plug-receiving opening of the receptacle. Obviously, the connector system for the equipment must preclude this possibility to avoid the potential for serious damage which might result from such mis-mating. In accordance with one embodiment thereof, the invention is directed to the achievement of a primary keying system for a series or family of electrical connector assemblies, the primary keying system functioning to prevent insertion of a relatively smaller plug into a larger receptacle than the size of the receptacle for which the plug is intended.

In addition to the need for a primary keying system, a conventional keying system is also required for connector assemblies of the type under consideration. If two connector assemblies of the same size (having the same number of terminals therein) are used in close proximity, it is possible to mis-mate the plugs and receptacles and the primary keying system discussed above would not preclude such mis-mating. A secondary keying system is thus needed specifically to keying a specific plug to a specific receptacle. The invention in accordance with a further aspect is directed to the achievement of an improved specific keying system and particularly to a specific keying system in combination with a primary keying system.

A preferred embodiment of the invention comprises a series of electrical connector assemblies, each assembly comprising a plug and a receptacle, each plug and each receptacle comprising a molded insulating housing having a mating end and a rearward end and having oppositely facing external housing sidewalls and oppositely facing external housing endwalls extending from the mating end to the rearward end. Each of the receptacles has a trough-like plug-receiving opening extending into its mating end, the plug-receiving opening in each receptacle having opposed plug opening sidewalls which are proximate to the external housing sidewalls and opposed plug opening endwalls which are proximate to the external housing endwalls. The plug of each connector assembly has a forward portion which extends from its mating end partially towards its rearward end and which is dimensioned to be received in the plug-receiving opening of the receptacle of the same assembly. A plurality of plug contacts are provided in the plug of each assembly and a like plurality of receptacle contacts in the receptacle of the same assembly. The receptacle contacts are within the plug receiving opening and are arranged in a row which extends between the plug opening endwalls. The plug contacts of each plug are proximate to the mating end of the plug and are arranged in a row which extends between the plug housing endwalls. The plug-receiving openings of the receptacles of the series are of increasing width, as measured between the plug opening endwalls, with increasing numbers of receptacle contacts in the receptacles, the plugs of the series similarly being of increasing width, as measured between the plug housing endwalls, with increasing numbers of plug contacts in the plugs. The height of the plug openings, as measured between the plug opening sidewalls, is uniform for all receptacles in the series. The series of electrical connectors is characterized in that a primary keying system is provided on the connector assemblies of the series, the primary keying system comprising, on each assembly of the series, at least one primary key on the receptacle of each assembly and at least one primary keyway in the plug of the same assembly, each primary key of the receptacle being aligned with a corresponding primary keyway of the plug of the same assembly.

The primary keys and primary keyways of the connector assemblies of the series having greater numbers of contacts are selectively located, relative to the locations of the primary keys and primary keyways of assemblies having lesser numbers of contacts, in a manner which prevents insertion of a plug having a lesser number of contacts into a receptacle having a greater number of contacts.

In accordance with a further embodiment, a secondary keying system is provided on the connector assemblies of the series for keying specifically a specific plug of the series to a specific receptacle. In accordance with a further embodiment, the secondary keys in the receptacles and secondary keyways in the plugs are dimensioned to preclude entry of a primary key therein into a secondary keyway.

A further embodiment comprises an electrical connector assembly of the type comprising a molded plug and a molded receptacle, the plug and receptacle being as described above. The assembly has a primary keying system comprising at least one primary key on the receptacle and at least one primary keyway in the plug. Each primary key of the receptacle is aligned with a corresponding primary keyway of the plug of the assembly. The primary keying system functions to permit insertion of the plug into the plug-receiving opening of the receptacle and to preclude insertion of a second plug, having a width as measured between its external housing endwalls which is less than the corresponding dimension of the plug, into the receptacle of the assembly.

In accordance with a further embodiment, a secondary keying system is provided in addition to the primary keying system, the secondary keying system functioning to prevent mis-mating of the plug and the receptacle with a substantially identical receptacle and a substantially identical plug respectively, which have the same primary keying system as the plug and receptacle.

DESCRIPTION OF THE DRAWINGS

FIGS. 1–3 show an eight position connector assembly 2 comprising a plug 4 and a receptacle 6. The assembly 2 incorporates a primary keying system and a secondary keying system in accordance with the invention. The structure of the assembly will first be described in detail. The relationship and significance of a keying system to a family or series of connectors will then be described with reference o FIGS. 4–15.

Figure 1:
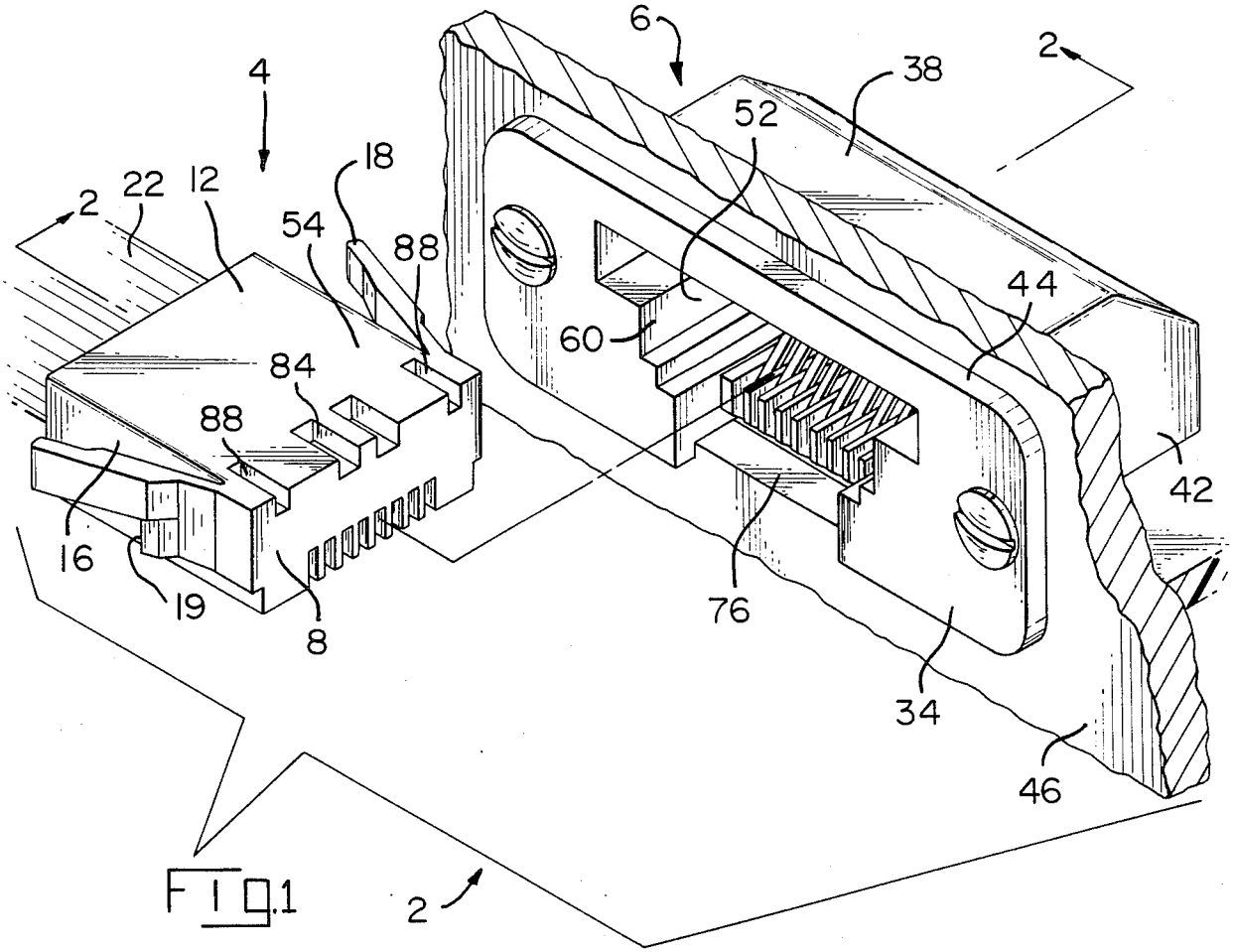
FIG. 1 is a perspective view showing an eight position connector assembly in accordance with the invention with the plug exploded from the receptacle.

The plug 4 is generally in accordance with the teachings of U.S. Pat. No. 3,860,316 and comprises an insulating housing having mating end 8, a rearward end 10, upper and lower housing sidewalls 12, 14 and oppositely facing housing endwalls 16. Latch arms 18 extend from the housing endwalls and have rearwardly facing shoulders 19 which engage shoulders 61 in the receptacle when the plug is mated with the receptacle.

A cable receiving opening 20 extends into the rearward end 10 and a cable 22 is inserted into this opening. The individual conductors 24 of the cable extend into a reduced cross section forward portion of the opening, the cable being retained by an integral strain relief clamp 26 and the conductors being retained by conductor strain relief means 28 as generally described in U.S. Pat. No. 3,860,316. The plug contact terminals 30 comprise flat stamped contact members and are received in recesses 32 which extend inwardly from the mating end 8 and inwardly from the lower sidewall 14. The contact terminals have insulation piercing portions which extend through openings and into the individual conductors 24. The plug contacts are engaged with the spring contact portions 72 of the receptacle contacts 62 when the plug is coupled to the receptacle.

The receptacle 6 is generally of the type shown in U.S. Pat. No. 4,221,458 and comprises a one piece molded insulating housing having a mating end 34, a rearward end 36, upper and lower external housing sidewalls 38, 40, respectively, and oppositely facing external housing endwalls 42. A flange 44 is provided on the mating end 34 and overlaps an opening in a panel 46. The receptacle is mounted on a circuit board 48 and may have integral interference-fit mounting projections 50 extending from its lower sidewall 40.

A plug-receiving opening 52 extends inwardly from the mating end 34 and receives the forward portion 54 of the plug 4. The forward portion extends from the mating end 8 of the plug for a substantial distance towards the rearward end and portions of the latch arms 18 are received in the opening 52 so that the shoulders 19 of the latches will engage the shoulders 61.

Plug-receiving opening 52 has upper and lower plug opening sidewalls 56, 58 and opposed plug opening endwalls 60. The receptacle contacts 62 comprise flat stamped sheet metal members arranged in side-by-side relationship in a row which extends between the plug opening endwalls 60. Each contact 62 has a post portion 64 which extends beyond the housing sidewall 40, through an opening in the circuit board, and is soldered to a conductor on the underside of the circuit board. Each contact also has an intermediate portion 66 which is received in a recess 68 extending inwardly from the lower sidewall 40 and a contact spring portion 72 which extends obliquely into the plug receiving opening. The contact is bent as shown at 70 and is recessed from the mating end 34. The free end of the contact portion 72 extends into a recess formed by spaced-apart barrier walls 73 at the inner end of the opening 52. These barrier walls prevent adjacent contacts from engaging each other. Barriers are also provided as shown at 74 between the bent portions 70 of adjacent contacts.

As shown in FIG. 1, the central lower portion 76 of the receptacle is open at the mating end to permit assembly of the contacts 62 to the housing and bending of the contact portions 72 as explained in U.S. Pat. No. 4,221,458.

Figure 2:
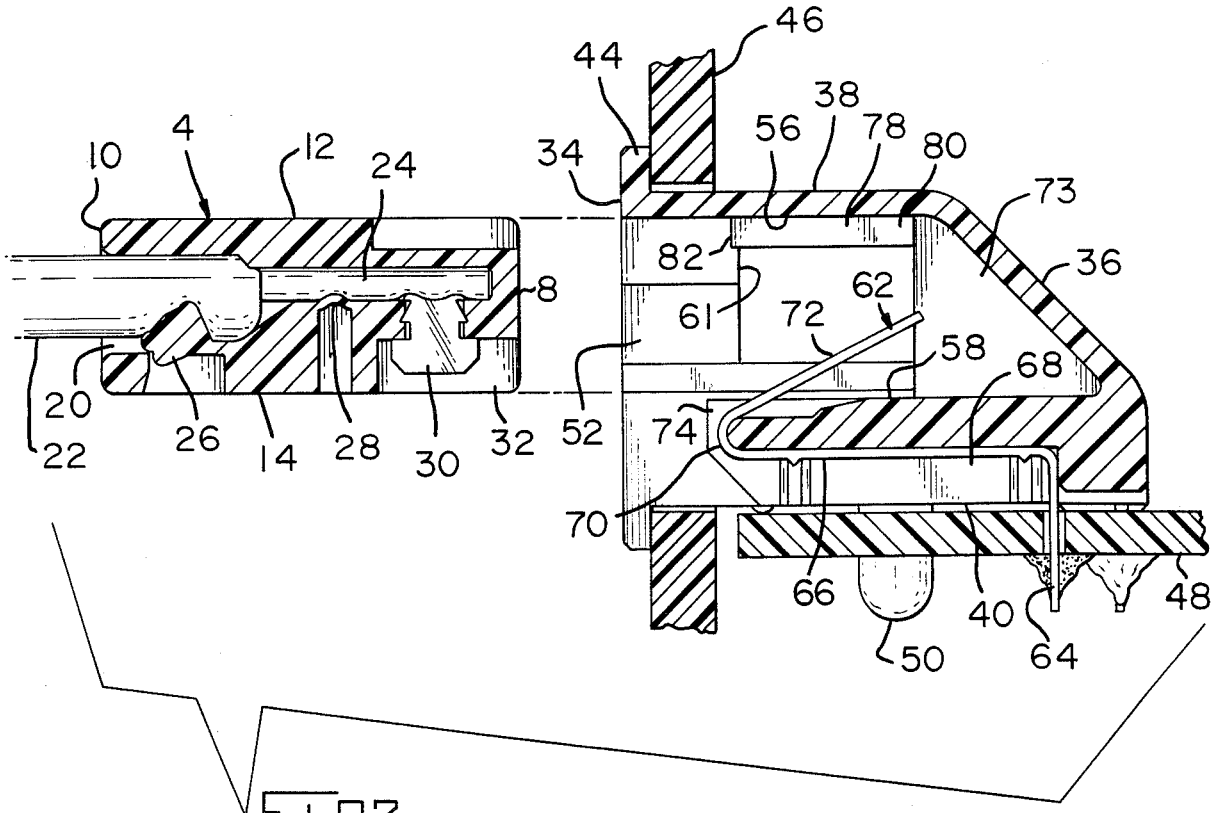
FIG. 2 is a cross-sectional view looking in the direction of the arrows 2—2 of FIG. 1 but with the plug in direct alignment with the receptacle.

The primary keying system comprising primary keys 78 which are molded integrally with the upper plug opening sidewall 56. Each key has an inner end 80 which is adjacent to the rearward end 36 of the housing and has a forward or outer end 82 which is located inwardly from the mating end 34 of the receptacle housing. In the particular eight position connector shown in FIGS. 1–3, two primary keys are provided in the receptacle, these keys being on each side of the center line and closely adjacent to the center line.

The corresponding primary keyways 84 in the plug 4 are dimensioned to receive the primary keys and are located on each side of, and adjacent to, the center line as required.

Figure 3:
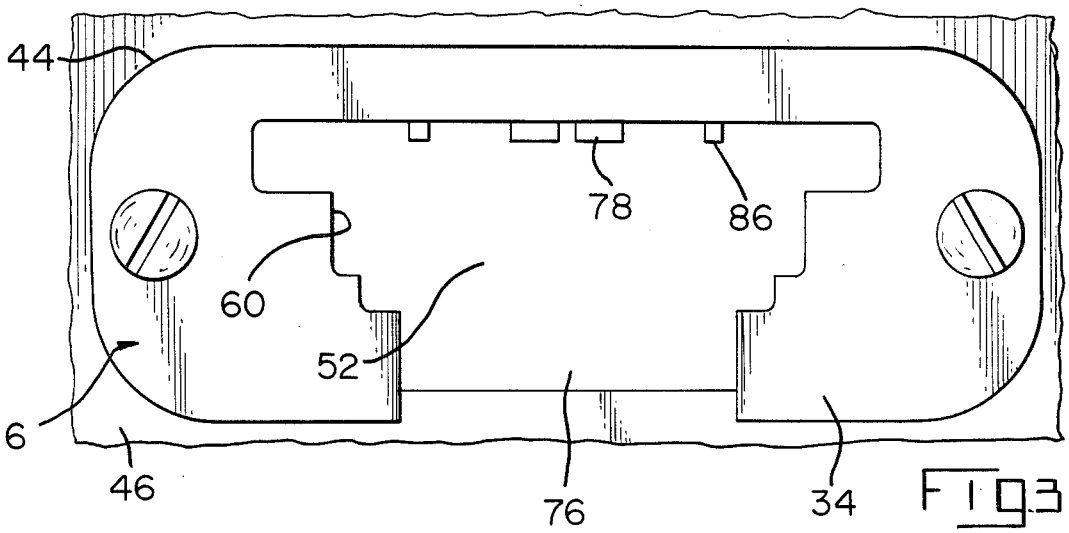
FIG. 3 is a semi-diagrammatic frontal view of the connector receptacle showing the primary and secondary keys.

As shown in FIG. 3, secondary keys 86 are provided on the upper plug opening sidewall 56 and are coextensive with the primary keys 78. The secondary keys 86 are of a generally square cross section and have a width in the disclosed embodiment which is about one-half of that of the primary keys. The secondary keyways 88 in the plug are coextensive with the primary keyways 84 and are of reduced width as compared with the primary keyways.

Figures 4, 5, 6, 7, 8, 9, 10, 11, 12, 13, 14, 15:
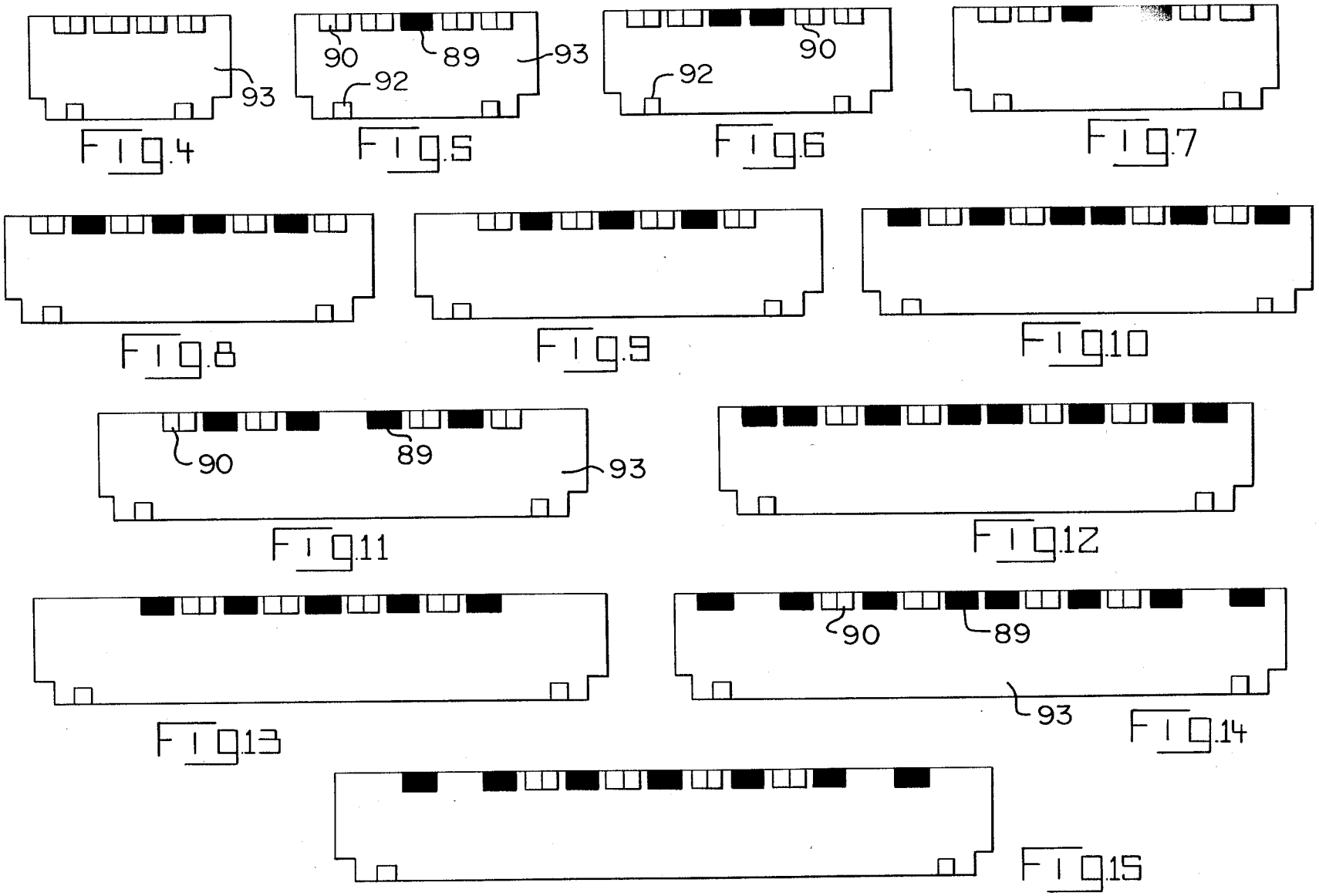
FIGS. 4–15 are a series of diagrammatic views illustrating the principles of the invention.

The functioning of the primary and secondary keying system will now be explained with reference to FIGS. 4–15. These figures are diagrammatic representations of the mating ends of a series of connector parts having increasing numbers of contacts. The enclosed areas 93 thus represent either the mating end 8 of the plug 4 or the mating end 34 of the receptacle 6. FIGS. 4–15 are based on a series of connector assemblies having four contacts in the smallest member of the series (FIG. 4) and having twenty-six contacts in the largest connector assembly of the series (FIG. 15). The intervening connector assemblies of FIGS. 5–14 each has two more contacts than the previous connector assembly. Thus FIG. 5 represents a connector assembly having six contacts, FIG. 6 represents a connector assembly having eight contacts and so on.

The darkened rectangles 89 in FIGS. 4–15 represent the locations of the primary keys 78 in the receptacles or the primary keyways 84 in the plugs. The smaller undarkened squares 90 represent the possible sites for secondary keys 86 or secondary keyways 88. It is possible to provide two secondary key sites on the lower opening sidewall 58 of the receptacle and corresponding keyways on the lower housing sidewall 14 of the plug as shown at 92.

Careful study of FIGS. 4–15 will establish that fact that it would be impossible to insert a plug 4 having a lesser number of contacts into a receptacle 6 having a number of contacts therein which is greater than the lesser number by virtue of the locations of the primary keys in the larger receptacle and the absence of keyways in smaller plug. This fact can be demonstrated by superimposing any one of FIGS. 4–14 on any other one of the figures which has an identifying number greater than that of the first figure. FIG. 4 of the disclosed embodiment, the four position connector assembly does not require a primary key and keyway.

In order specifically to key a plug and receptacle of the same size to each other, a secondary key is provided in one of the secondary key and keyway sites 90, 92 in the receptacle and a corresponding keyway is provided in the plug. It will be noted that the secondary key and keyway sites 90, 92 have a width which is only about one-half that of the width of the primary keys and keyways. It follows that there is no possibility that a secondary keyway will receive a primary key of a receptacle for which the plug is not intended, in other words, a receptacle having a greater number of contacts therein than the plug.

The relatively large number of potential sites for secondary keys and keyways provides the capability of a large number of unique combinations of secondary keys and keyways and therefore a correspondingly large number of unique keying arrangements for connector assemblies within the series or family. In the example for a connector family or series shown in FIGS. 4–15, the number of secondary key and keyways sites 90, 92 has been limited to ten such sites. In the larger size connector, additional secondary key and keyway sites could be provided as desired with a resulting increase in the number of unique or specific keying combinations.

The primary and secondary keying systems of the invention can be provided in a series of family of connector assemblies with relative ease in the manufacturing process. The plug and receptacle shown in FIG. 1 are such that they can be molded with a "straight action mold", that is, a mold in which all of the core pins extend parallel to the direction of movement of the mold halves towards and away from each other when the mold is open and closed. A straight action mold is relatively simple as compared with a "side draw" mold in which core pins extend normally of the direction of movement of the mold parts. The primary and secondary keys and keyways in the plug and receptacle are formed by core pins which extend in the direction of movement of the mold parts. In the embodiment shown, these core pins are of similar rectangular cross section. It follows that core pins can be placed in the mold parts or removed from the mold parts with relative ease to form the desired secondary keys and keyways. The core pins which form the primary keys and keyways would ordinarily remain permanently in the mold parts.

Figure 16:
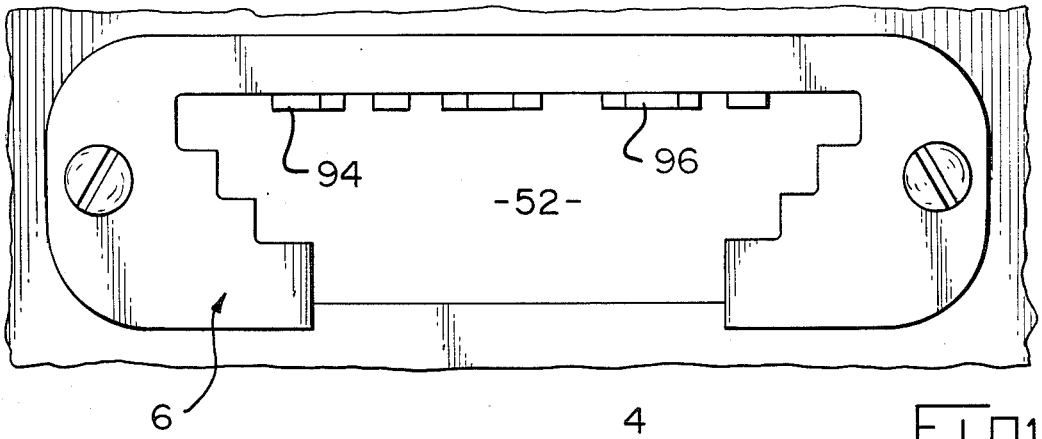
FIG. 16 is a view similar to FIG. 3 showing an alternative embodiment.
Figure 17:
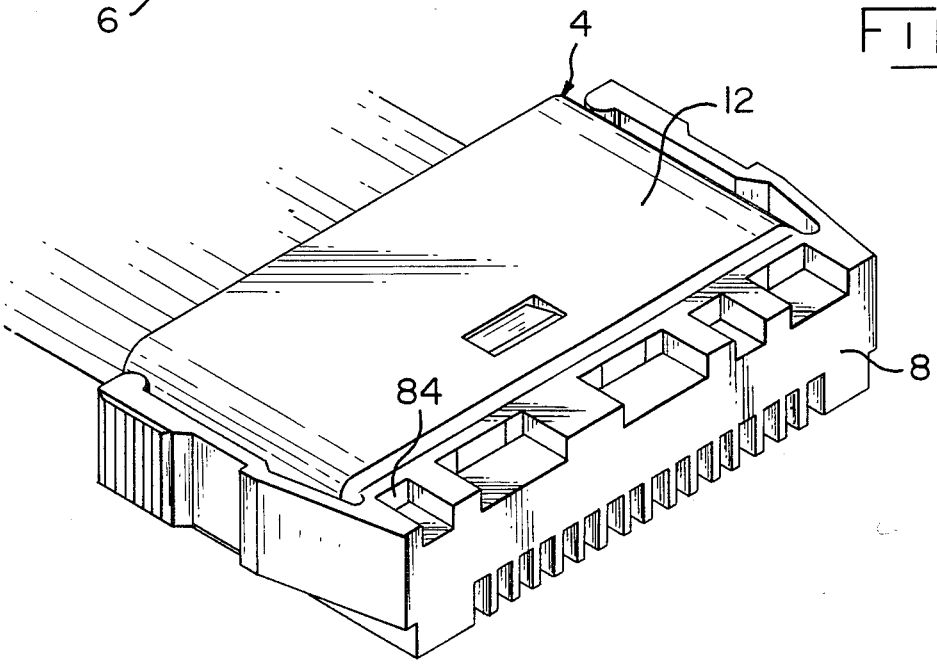
FIG. 17 is a perspective view of a plug which is intended to be mated with the receptacle of FIG. 16.

FIGS. 16 and 17 show an alternative embodiment in which a primary key and one or two adjacent secondary keys are replaced by composite keys as shown at 94 and 96 in FIG. 16. This expedient might be employed if the secondary keys require strengthening and if it is found to be impractical to form the very thin webs or barrier walls in the plug between the primary keyway and the secondary keyway. The composite key 94 thus comprises a primary key, a secondary key, and molded material which fills the gap between the two keys. The composite key 96 comprises a primary key and two secondary keys in addition to the material between the primary key and the secondary keys.

I claim:

1. A series of electrical connector assemblies, each assembly comprising a plug and a receptacle, each plug and each receptacle comprising a molded insulating housing having a mating end and a rearward end and having oppositely facing external housing endwalls extending from the mating end to the rearward end, each of the receptacles having a trough-like plug-receiving opening extending into its mating end, the plug-receiving opening in each receptacle having opposed first and second plug opening sidewalls which are proximate to the external housing sidewalls and opposed plug opening endwalls which are proximate to the external housing endwalls, the plug of each connector assembly having a forward portion which extends from its mating end partially towards its rearward end and which is dimensioned to be received in the plug-receiving opening of the receptacle of the same assembly, a plurality of plug contacts in the plug of each assembly and a like plurality of receptacle contacts in the receptacle of the same assembly, the receptacle contacts being within the plug receiving opening and being arranged in a row which extends between the plug opening endwalls, the plug contacts of each plug being approximate to the mating end of the plug and being arranged in a row which extends between the plug housing endwalls, the receptacle contacts in each receptacle of the series extending from the first plug opening sidewall at a location adjacent to the mating end of the receptacle, the receptacle contacts being spring contacts which extend obliquely into the plug-receiving opening, the plug-receiving openings of the receptacles of the series being of increasing width, as measured between the plug opening endwalls, with increasing numbers of receptacle contacts in the receptacles, the plugs of the series similarly being of increasing width, as measured between the plug housing endwalls, with increasing numbers of plug contacts in the plugs, the height of the plug openings, as measured between the plug opening sidewalls, being uniform for all receptacles in the series, the series of electrical connectors being characterized in that:

a primary keying system is provided on the connector assemblies of the series, the primary keying system comprising, on each assembly of the series, at least one primary key on the receptacle of each assembly and at least one primary keyway in the plug of the same assembly, each primary key of the receptacle being aligned with a corresponding primary keys of each receptacle being molded integrally on the second opening sidewall which is opposite to the first plug opening sidewall from which the receptacle contacts extend, the primary keys and primary keyways of the connector assemblies having greater numbers of contacts and greater widths being selectively located, relative to the locations of the primary keys and primary keyways of assemblies having lesser numbers of contacts and lesser widths to prevent insertion of a plug having a lesser width and a lesser number of contacts into a receptacle having a greater width and a greater number of contacts, and a secondary keying system is provided on the connector assemblies of the series for keying specifically a specific plug of the series to a specific receptacle, the secondary keying system comprising secondary keys in the receptacles and secondary keyways in the plugs, the secondary keyways being dimensioned to preclude entry of a primary key therein.

2. A series of electrical connector assemblies, each assembly comprising a plug and a receptacle, each plug and each receptacle comprising a molded insulating housing having a mating end and a rearward end and having oppositely facing external housing endwalls extending from the mating end to the rearward end, each of the receptacles having a trough-like plug-receiving opening extending into its mating end, the plug-receiving opening in each receptacle having opposed first and second plug opening sidewalls which are proximate to the external housing endwalls and opposed plug opening endwalls which are proximate to the external housing endwalls, the plug of each connector assembly having a forward portion which extends from its mating end partially towards its rearward end and which is dimensioned to be received in the plug-receiving opening of the receptacle of the same assembly, a plurality of plug contacts in the plug of each assembly and a like plurality of receptacle contacts in the receptacle of the same assembly, the receptacle contacts being within the plug receiving opening and being arranged in a row which extends between the plug opening endwalls, the plug contacts of each plug being proximate to the mating end of the plug and being arranged in a row which extends between the plug housing endwalls, the receptacle contacts in each receptacle of the series extending from the first plug opening sidewall at a location adjacent to the mating end of the receptacle, the receptacle contacts being spring contacts which extend obliquely into the plug receiving opening, the plug-receiving openings of the receptacles of the series being of increasing width, as measured between the plug opening endwalls, with increasing numbers of receptacle contacts in the receptacles, the plugs of the series similarly being of increasing width, as measured between the plug housing endwalls, with increasing numbers of plug contacts in the plugs, the height of the plug openings, as measured between the plug opening sidewalls, being uniform for all receptacles in the series, the series of electrical connectors being characterized in that:

a primary keying system is provided on the connector assemblies of the series, the primary keying system comprising, on each assembly of the series, at least one primary key on the receptacle of each assembly and at least one primary keyway in the plug of the same assembly, each primary key of the receptacles being aligned with a corresponding primary keyway of the plug of the same assembly; the primary keys of each receptacle being molded integrally on the second sidewall which is opposite to the first plug opening sidewall from which the receptacle contacts extend, the primary keys and primary keyways of the connector assemblies having greater numbers of contacts and greater widths being selectively located, relative to the locations of the primary keys and primary keyways of assemblies having lesser numbers of contacts and lesser widths to prevent insertion of a plug having a lesser width and a lesser number of contacts into the receptacle having a greater width and a greater number of contacts and a secondary keying system provided on the connector assemblies of the series for specifically keying a specific plug of the series to a specific receptacle, the secondary keying system comprising secondary keys in the receptacles and secondary keyways in the plugs, the secondary keys being integrally molded on the second opening sidewall, the secondary keys and keyways being between primary keys and keyways in at least some of the receptacles, the secondary keyways being dimensioned to preclude entry of a primary key therein.

3. A series of electrical connector assemblies as set forth in claim 1 characterized in that at least one composite key is provided in at least one receptacle of the series, the composite key comprising a primary key and a secondary key which is immediately adjacent to the primary key, the intervening space between the primary key and the secondary key being filled with molded material, the complementary keyway for the composite key being a composite keyway which is dimensioned to receive the composite key.

* * * * *